United States Patent [19]

Ray

[11] 4,179,122

[45] Dec. 18, 1979

[54] MARBLE GAME APPARATUS

[76] Inventor: Otis E. Ray, P.O. Box 40302, St. Petersburg, Fla. 33743

[21] Appl. No.: 913,688

[22] Filed: Jun. 8, 1978

[51] Int. Cl.[2] ..... A63F 7/00; A63B 67/04

[52] U.S. Cl. ..... 273/85 R; 273/57; 273/118 R; 273/127 B

[58] Field of Search ..... 273/176 J, 195 A, 177 R, 273/178 R, 127 R, 127 B, 56, 57, 14, 85 R, 176 B, 176 F, 118 R, 87 B, 87 C

[56] References Cited

U.S. PATENT DOCUMENTS

| | | | |
|---|---|---|---|
| 650,996 | 6/1900 | Strong | 273/57 |
| 721,764 | 3/1903 | White | 273/57 |
| 2,636,740 | 4/1953 | McNeal | 273/118 R |
| 2,912,248 | 11/1959 | Di Buono | 273/176 F |
| 3,425,696 | 2/1969 | Dockum | 273/85 R X |
| 3,526,404 | 9/1970 | Wiggins | 273/118 R |
| 4,124,210 | 11/1978 | Mason | 273/176 F |

FOREIGN PATENT DOCUMENTS

| | | | |
|---|---|---|---|
| 27586 | of 1902 | United Kingdom | 273/57 |

*Primary Examiner*—George J. Marlo
*Attorney, Agent, or Firm*—B. P. Fishburne, Jr.

[57] ABSTRACT

An artificial grass mat is employed with glass marbles or small plastic balls for playing standard marbles, modified pool or table croquet. In all cases, the marbles or balls are propelled by knuckle or finger action without the use of mallets or cue sticks. Croquet wickets and goal posts are fabricated from readily bendable pipe cleaners and are anchored to plastic mounting plates which lie beneath the playing mat. The wickets and posts are received removably through slits and openings in the grass mat enabling the mat to be used selectively for at least three different forms of games. A safe rack formed of flexible plastic is employed for racking marbles or balls in the pool game. A perimeter netting on a supporting board or table structure confines marbles or balls to a shallow trough or gutter area surrounding the playing mat.

9 Claims, 6 Drawing Figures

FIG.1
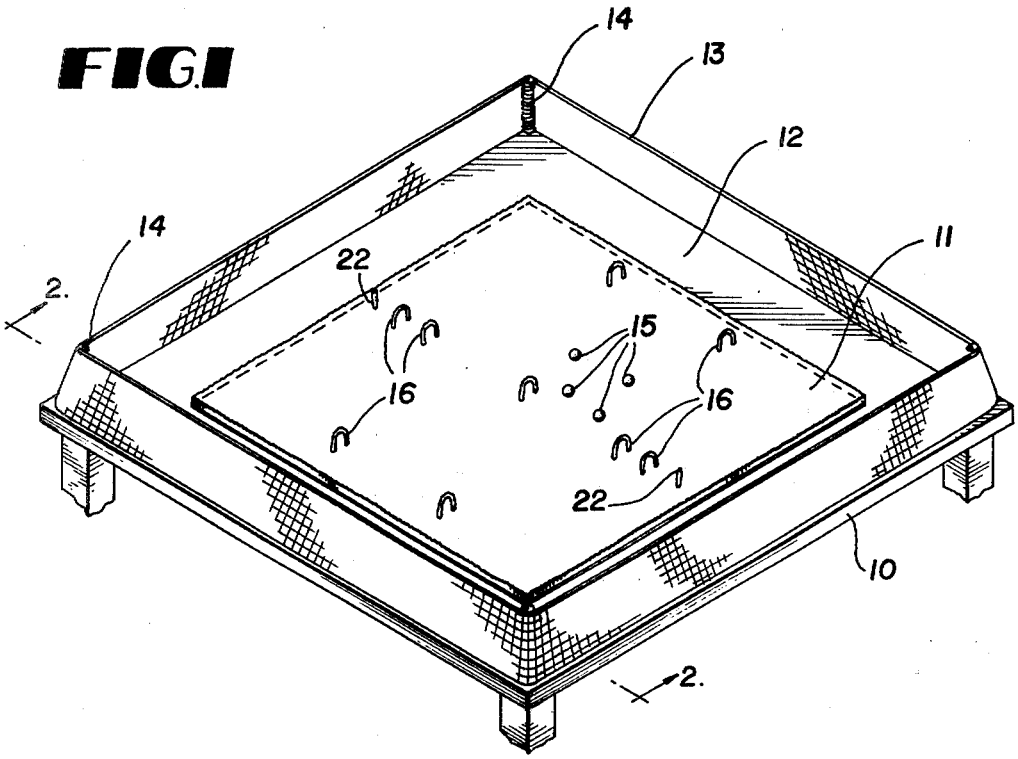
FIG.2
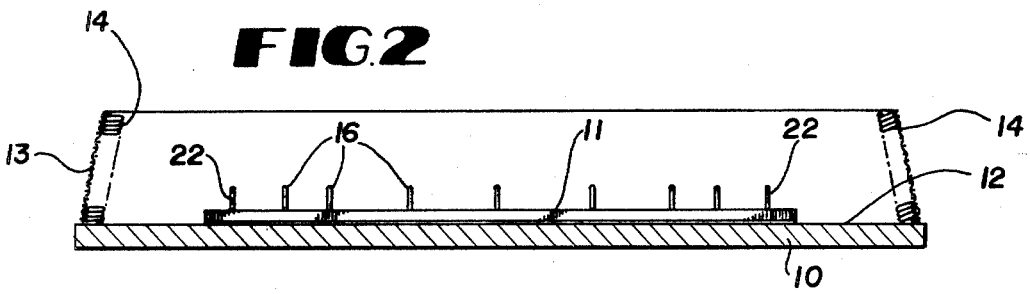
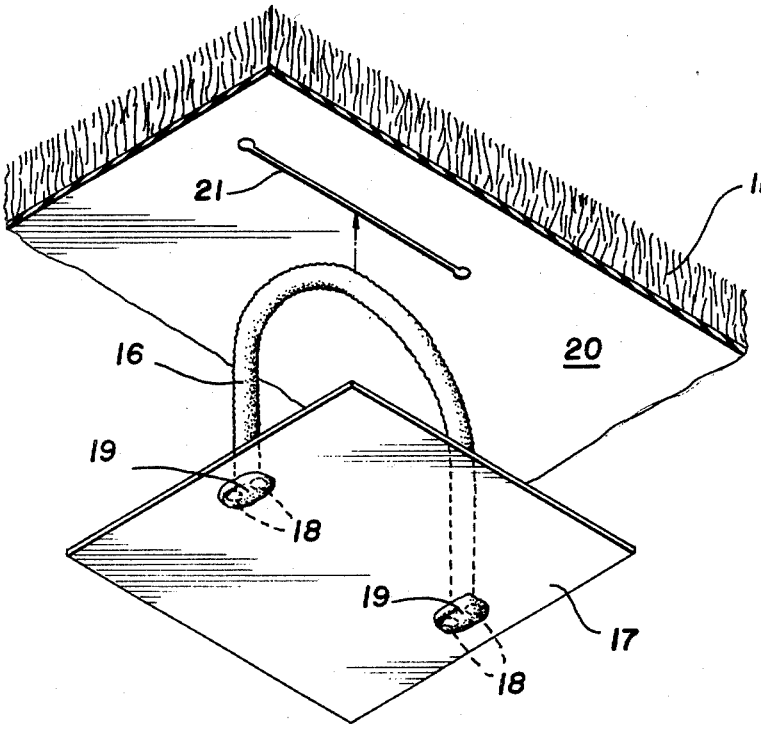
FIG.3

MARBLE GAME APPARATUS

BACKGROUND OF THE INVENTION

The objective of the invention is to fulfill a need in the art for a more versatile, more interesting, less expensive and durable game apparatus of the type employing marbles or small balls molded from nylon or the like for the selective playing of several different games by use of the one apparatus.

More particularly, the game apparatus features an artificial carpet grass or turf mat which constitutes an ideal playing surface for games utilizing glass marbles or small plastic balls. The artificial grass surface is neither too fast nor too slow for the purposes of the games being played with marbles or small balls. This has been one of the difficulties in the prior art with marble-type table games which have employed felt surfaces similar to pool tables. Such surfaces are much too fast to allow proper control of marbles. The present artificial grass mat closely approximates the playing quality of traditional outdoor dirt surfaces commonly utilized for the old-fashioned school yard marble game.

The artificial grass mat utilized in the invention enables the marble type games to be played indoors as on a table or on a floor surface, or outdoors. The establishment of outdoor recreation centers is contemplated at which permanent tables or slabs formed of concrete can be constructed to support the playing mats and other accessories which are taken indoors for safekeeping at night. The apparatus is equally suitable for indoor games, as will be further described in full detail. Many features and advantages of the invention over the known prior art will become apparent during the course of the following description.

To comply with the duty to disclose known prior art under 37 C. F. R. 1.56, the following United States patents are made of record herein: U.S. Pat. Nos. 104,151; 2,219,675; 197,504; 2,636,740; 246,208; 2,639,151; 3,578,321.

BRIEF DESCRIPTION OF THE DRAWINGS

FIG. 1 is a perspective view of the invention according to one preferred embodiment thereof.

FIG. 2 is an enlarged vertical section taken on line 2—2 of FIG. 1.

FIG. 3 is an enlarged fragmentary exploded perspective view of an artificial grass mat having a slit to receive a removable croquet wicket secured to a wicket mounting plate.

DETAILED DESCRIPTION

Figure 4:
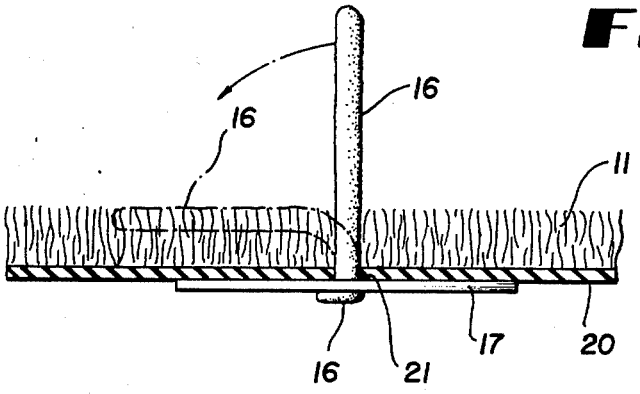
FIG. 4 is a fragmentary vertical section taken through the mat at a wicket and illustrating how wickets can be bent down flush with the artificial grass playing surface.

Referring to the drawings in detail wherein like numerals designate like parts, the numeral 10 designates a level table, such as a card table, on which games embodied in the invention are played. Disposed centrally on the table 10 is a flexible game play surface mat 11 of rectangular configuration formed of artificial grass or carpet grass of the type commonly employed for the playing surfaces of football stadiums under various well-known trade names. Commercial carpet grass surfaces are found to be ideal for playing games in which glass marbles or small balls of molded nylon are propelled by knuckle or finger action, as in the traditional game of marbles. The "speed" of the carpet grass mat 11 is found to be ideal for these games, in contrast to felt surfaces which are too hard and too fast and other pile type surfaces which are too soft and too slow for marbles. A further advantage of the artificial grass mat 11 is that it is substantially weather-proof, enabling the games of the invention to be played indoors or outdoors. The mat being flexible can easily be rolled up for storage when not in use. In this connection, the game apparatus according to the invention is very suitable for outdoor playground type recreation centers which may contain permanent concrete tables or slabs on which the mats 11 can be placed during the day and are taken indoors for safekeeping at night. A feature of the invention, therefore, is its versatility not only in terms of several games which can be played by means of the basic game apparatus but also in terms of the many places where the games can be played, indoors or outdoors.

It may be mentioned that, in lieu of a separate table 10, the carpet grass mat 11 may be utilized with a flat relatively rigid gameboard to which the mat 11 could be fixed along one edge thereof, if preferred.

In the illustrated embodiment, the table 10 is of such size that a uniform width perimeter trough or gutter 12 is formed around the four sides of the mat 11 to receive marbles or balls knocked from the mat during the playing of regular marbles or modified pool, in a manner to be described. Preferably, a perimeter net 13 of plastic which is essentially transparent is provided in the apparatus to prevent the playing marbles from rolling completely beyond the apparatus and retaining them in the out-of-play trough area 12. The net 13 is supported in an inclined upwardly convergent position by four corner located yielding coil springs 14 which are anchored to the table 10 suitably. When the barrier net is slipped over the springs 14, the latter are tensioned to retain the net 13 taut and in the inclined position illustrated. In some cases, the springs 14 may be attached to the table 10 by removable clamp-type supports, as in the case of outdoor concrete tables at play centers. The perimeter trough area 12 is also used by the players for "knuckling down" as in the playing of standard marbles or the pool game, to be described.

As illustrated in FIGS. 1 to 4, the apparatus is used to play a miniature form of croquet. For this purpose, the players utilize marbles 15 of different colors, one for each player, or molded nylon balls having a preferred diameter of about one-half inch. As with all of the games played with the apparatus, the marbles 15 are propelled on the mat 11 by knuckle or finger action. In the case of croquet, the marbles 15 are thumped or struck as by flicking the middle finger of the hand against the marble while aiming it at a given wicket. The croquet course in FIG. 1 is arranged exactly like a full sized course and the only difference in the layout of the course is miniaturization.

Each croquet wicket 16 for the sake of child safety and also for convenience and economy is formed from the readily bendable material commonly used to make smoking pipe cleaners. Each wicket has its vertical legs anchored to a thin flat preferably plastic mounting plate 17 provided near opposite sides, FIG. 3, with pairs of small apertures 18 through which the lower terminals of the wicket legs may be passed with a short bight portion 19 of each wicket arranged at the bottom of the mounting plate 17 and the remainder of the wicket extending vertically above the plate 17. The arrangement is secure, very economical to make, and safe.

At appropriate locations, the base sheet 20 of the carpet grass mat 11 is slit as at 21 so that the wickets can be forced upwardly through these slits with their plates 17 abutting the bottom surface of the sheet 20. When the mat is laid out flat on the table 10 or on a gameboard or floor, the weight of the mat on the mounting plates 17 stabilizes the wickets 16 without the necessity of any further means of attachment. When converting the apparatus for usage in playing standard marbles or pool, the wickets 16 are merely withdrawn through the slots 21 and the same mat 11 is employed for the other games. A pair of croquet goal posts 22 is also provided at proper locations near opposite edges of the mat 11 and these posts are attached to additional plates 17 in the manner illustrated and described for the wickets. In lieu of the slots 21, the mat 11 has small apertures formed through its base sheet 20 to allow upward insertion of the goal posts 22 and removal thereof in the same manner described for the wickets. The posts 22 and the wickets 16 are easily bent over to horizontal positions flush with the artificial grass playing surface, FIG. 4. This is to facilitate rolling up the mat in some cases with the wickets and posts in place and to enable certain difficult player shots in the croquet game where one wicket may be blocking the approach to another wicket or post. It should be noted that in the croquet game as in all of the other games played with the apparatus the marbles or small nylon balls are propelled solely by knuckle or finger action without any mallet, cue or other striking implement. This enhances the safety of the games for children, reduces cost, and increases the skill required for play. The absence of mallets or striking devices in the game apparatus also encourages the return of the almost lost art of shooting marbles which was once so popular and so much a part of the American scene. This is one of the objectives of the invention.

To convert the apparatus to a regular marble game, it is only necessary to lift the mat 11 and completely remove the croquet wickets 16 and posts 22. This can easily be done regardless of whether the mat 11 is attached to the table 10 along one edge or freely disposed on the table.

In the case of outdoor recreation centers, wickets can be permanently installed in heavy wooden or concrete tables and the slitted and apertured mat 11 can be placed over the wickets and goal posts for play and removed for inside storage at night, as previously noted.

Figure 5:
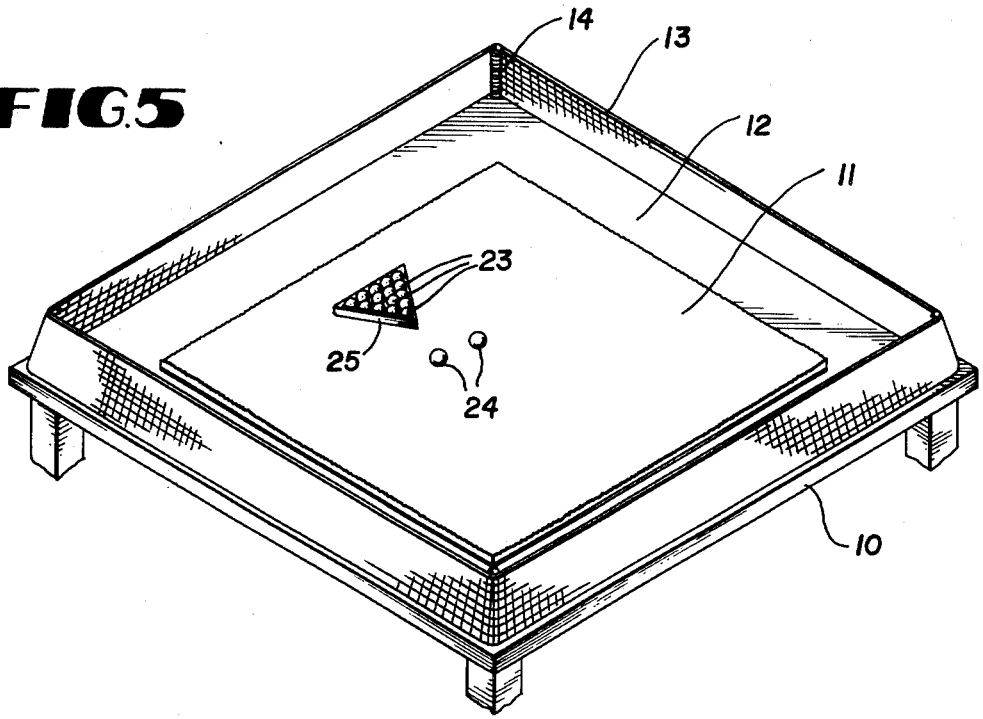
FIG. 5 is a perspective view of the game apparatus according to a variant in which a modified pool game is played.
Figure 6:
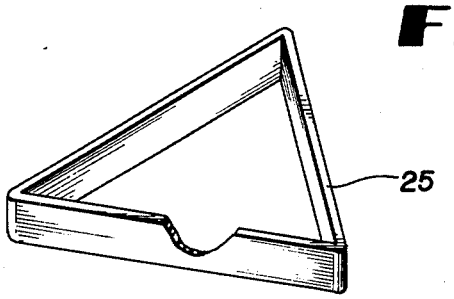
FIG. 6 is a perspective view of a rack for marbles or small balls simulating pool balls and formed of somewhat flexible plastic for the safety of children.

For playing modified pool without pockets, FIGS. 5 and 6, the wickets 16 and posts 22 are removed in the described manner and the usual number of pool balls 23 in the form of marbles or small nylon balls are provided in two contrasting color sets along with an "eight ball" in a third color, such as black. Two slightly larger diameter shooters or cue balls 24 are provided and these may be white three-quarter inch diameter marbles or balls.

A triangular rack 25 formed of semi-flexible plastic strapping is employed for the safety of children and the marbles are racked as illustrated and the game is played generally like regular pool except that no pockets are provided and the shooters 24 are propelled by finger or knuckle action, as in standard marbles.

In some instances, the perimeter net 13 can be eliminated entirely, although its presence is a desirable feature to prevent the escape of marbles from the table or board.

It is thought that the various improvement features of the game apparatus over the known prior art should now be apparent. It should be noted, however, that when the wickets 16 are removed from the artificial grass mat 11, there is no evidence of the presence of the slits 21 from the top playing surface of the grass mat enabling the latter to be used efficiently for regular marbles or pool. The fact that the artificial grass possesses a regular grain direction renders it more difficult to shoot against the grain than with the grain and renders shooting across the grain a bit more erratic. Another novel feature is that the corner spring supports 14 for the net 13 allows players to depress the net with their hands if needed during shooting, the net automatically returning to its nearly upright condition upon release.

As used herein, the terms "artificial grass" and "carpet grass" are synonymous and pertain to a product in which a multitude of discrete tufts of plastic fibers are anchored in a rubberized fabric base sheet which is the sheet 20 described in the application. The tufts of fibers are closely spaced to produce a continuous evenly clipped grass-like surface. The tufts and fibers are approximately one-quarter inch long. The product is also known as "artificial turf". The fibers are bright green to simulate natural grass.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A game apparatus for use in playing several specifically different games utilizing rolling spheres propelled by knuckle or finger action, said apparatus comprising a flexible artificial grass mat adapted for placement on a level supporting surface to thereby form a level and smooth playing surface on which spheres propelled by finger or knuckle action of players can roll, said artificial grass mat having a base sheet provided with spaced narrow slits arranged on the mat in the pattern of a miniature croquet course, and croquet wickets adapted for removable insertion upwardly through said slits from beneath said mat so that the bights and legs of the wickets project well above said level and smooth playing surface and said spheres can be propelled by players through said wickets during the playing of croquet, and said mat being convertible to a playing surface for a pool-like game and/or a regular game of marbles by the removal of said wickets from said slits, and there being no discernible gaps or irregularities in said playing surface due to said slits.

2. A game apparatus as defined in claim 1, and said wickets being formed of non-springy easily bendable rod material of the type used for smoking pipe cleaners.

3. A game apparatus as defined in claim 2, and each wicket having a thin flat wicket mounting plate disposed beneath said mat and to which the legs of the wicket are attached.

4. A game apparatus as defined in claim 3, and a pair of croquet goal posts formed of the same material as the wickets and being attached to thin flat mounting plates for disposition beneath said mat and being removably insertable upwardly through apertures in the base sheet of said mat.

5. A game apparatus as defined in claim 1, and said apparatus additionally comprising a small triangular rack for spheres simulating pool balls and formed of semi-rigid bendable plastic strapping.

6. A game apparatus as defined in claim 1, and a substantially rigid level supporting surface for said mat and projecting somewhat beyond the marginal edge of the mat on all sides of the mat and forming a depressed area around the mat for the collection of spheres struck from the surface of the mat by game players and also providing an area for "knuckling down" by game players around the margin of said mat, and a barrier element for rolling spheres on said supporting surface and surrounding said depressed area.

7. A game apparatus as defined in claim 6, and said mat being attached to said level supporting surface along one edge thereof, said mat, said supporting surface and said barrier element being rectangular.

8. A game apparatus as defined in claim 6, and said barrier element comprising flexible netting, and corner support posts for said netting in the form of coil springs anchored to said supporting surface and yielding when hand pressure is exerted on the netting so that the netting may be depressed by game players and will return automatically to its normal position upon release.

9. A game apparatus as defined in claim 8, and said netting being normally taut and inclined, and said coil springs being normally held in inclined positions by the taut netting.

* * * * *